United States Patent [19]

Runyan

[11] Patent Number: 4,595,920

[45] Date of Patent: Jun. 17, 1986

[54] LOW-LOSS SINUSOIDAL DRIVE SYSTEM AND TECHNIQUE

[75] Inventor: Wesley G. Runyan, Cedar Rapids, Iowa

[73] Assignee: Rockwell International Corporation, El Segundo, Calif.

[21] Appl. No.: 523,998

[22] Filed: Aug. 17, 1983

[51] Int. Cl.[4] ..... G09G 3/00

[52] U.S. Cl. ..... 340/805; 340/760

[58] Field of Search ..... 340/781, 805, 811, 760

[56] References Cited

U.S. PATENT DOCUMENTS

| | | | |
|---|---|---|---|
| 4,070,663 | 1/1978 | Kanatani et al. | 340/811 X |
| 4,196,432 | 4/1980 | Chihara | 340/811 X |
| 4,253,097 | 2/1981 | Hochstrate | 340/781 |

*Primary Examiner*—Gerald L. Brigance
*Assistant Examiner*—Vincent P. Kovazuk
*Attorney, Agent, or Firm*—George A. Montanye; H. Fredrick Hamann

[57] ABSTRACT

A low-loss sinusoidal drive system is disclosed for powering thin-film electroluminescent displays (TFEL). A DC power source coupled through a DC-to-AC inverter and driving an LC resonant tank circuit is used to produce a sinusoidal supply voltage. The sinusoidal supply voltage is coupled to produce a sinusoidal backplane driving voltage and coupled to a synchronizer circuit which controls drive logic for selectively energizing segments of the TFEL display. The drive logic is coupled to respond to an on-off command for selecting a particular segment such that the average DC voltage across a segment of the TFEL is zero, independent of the on/off condition of the segment. The backplane sinusoidal voltage may be applied in common to multiple TFEL devices with the synchronizing and drive logic circuits individually selecting the segments for TFEL drive.

14 Claims, 8 Drawing Figures

LOW-LOSS SINUSOIDAL DRIVE SYSTEM AND TECHNIQUE

BACKGROUND OF THE INVENTION

The present invention relates to power supply and drive circuits and, more particularly, to a sinusoidal drive system for thin-film electroluminescent displays.

Recent developments in thin-film electroluminescent displays (TFEL) have made such devices attractive for use in a variety of display systems. Such devices are capable of providing excellent display clarity in adverse ambient light conditions and are capable of extended operation over wide temperature ranges. Such features are highly desirable in many avionics systems and particularly in military aircraft which must be capable of operating in severe environments. Use of these devices has been restricted, however, due to the complexity and the power inefficiency of the drive circuits needed to power the TFEL displays.

In conventional TFEL power supplies and drive systems, square waves have been extensively used. While this technique is successful in providing the requisite operation of the TFEL displays, the operation is achieved only with high power dissipation and therefore low system efficiency. This is caused by the highly capacitive electrical nature of the TFEL devices which results in large reactive currents when driven by the square wave thereby resulting in the noted power dissipation. As a result of this operation, even though the luminous efficiency of the TFEL devices is high, power losses produced by the power supply and circuit conductors render the system much less efficient and therefore impractical in many environments.

In other instances, attempts have been made to drive the TFEL devices and accompanying displays by use of a resonating technique. In such instances, an inductance is used to produce a resonant circuit (using the inherent TFEL capacitance) which requires less power for system drive and results in less power dissipation. Such attempts, however, require highly complex circuits with additional losses and have not resulted in TFEL power supply and drive systems with much practical application. As will be understood, the above described technique requires separate circuits for each TFEL element to take advantage of the inherent capacitive reactance to produce the resonant circuit. Naturally, in the environments in which their use is intended, simplicity, low cost, and highly reliable operation with little power dissipation is required.

In order to overcome the above deficiencies, it has been suggested that sinusoidal drives be used in lieu of the square wave drive. As would immediately be apparent, a straight application of a sinusoidal drive in place of the square wave would not produce much additional benefit if the sinusoidal waveform were to be produced merely by amplifying a low-level sinusoid. This would be due to the additional power loss incurred in the linear amplification of the low level sine waveform needed to convert a sine wave to a level sufficient to drive the TFEL devices. Again, such a system would not be desirable where highly power efficient circuits are required to drive the TFEL displays.

Accordingly, there is still a need for the development of TFEL power supply and drive systems which may be implemented on single chips with conventional integrated circuit techniques, and be produced by high volume production techniques. The present invention has therefore been developed to overcome the shortcomings of the above known and similar techniques and to produce an improved and highly efficient TFEL power supply and drive system.

SUMMARY OF THE INVENTION

In accordance with the present invention, a sinusoidal power supply is used to drive the TFEL devices. In this instance, the sinusoidal drive system uses an efficient DC-to-AC inverter circuit coupled to a DC power source to drive an LC tank circuit for producing a sinusoidal output wave. The sinusoidal output wave is coupled to produce a common backplane voltage and also to produce a DC voltage clamping rail for use in individually driving the TFEL segments. The sinusoidal supply voltage is coupled through a synchronizer circuit which operates drive logic for selectively clamping the TFEL segments to the DC voltage and to ground. A selectable on/off logic input produces signals which enable or inhibit the energization of a particular segment. A plurality of logic drive circuits may be coupled to energize the individual TFEL segments of multiple TFEL devices. At the same time, the common backplane voltage may be used with each of a plurality of separate TFEL devices in a system, thereby reducing the over-all complexity of the power supply and drive system.

It is therefore a feature of the invention to provide an improved power supply and drive system for TFEL displays.

It is a further feature of the invention to provide a power supply and drive system of reduced complexity for TFEL displays which render such systems more versatile for use in many environments.

A still further feature of the invention is to provide a TFEL power supply and drive system which may be implemented with low-cost integrated circuit techniques.

A yet further feature of the invention is to provide a TFEL display power source which utilizes a sinusoidal drive waveform.

Yet another feature of the invention is to provide a sinusoidal TFEL power supply by use of a resonant circuit driving a TFEL device.

Another feature of the invention is to provide a TFEL power source which reduces power losses in operation, thereby rendering the system more efficient.

Still yet another feature of the invention is to provide a TFEL power supply which provides zero DC offset voltages.

These and other advantages and novel features of the invention will become apparent from the following detailed description when considered with the accompanying drawings wherein:

DETAILED DESCRIPTION OF A PREFERRED EMBODIMENT

Thin-film electroluminescent displays and the devices used to implement such displays are well known in the prior art. Recently, the technology has advanced rapidly and improvements in the devices have made them highly attractive for use in a variety of display systems including commercial and military avionics. Since such TFEL devices are generally well-known, they will not be described with great detail herein. Reference may be made to *The Proceedings of the Society for Information Display,* Volume 22, No. 1, 1981, pp. 47–62, for exemplary embodiments of conventional TFEL devices to which the present invention is applicable.

Generally, however, a TFEL display is formed from individual TFEL devices which include a plurality of segments that may be individually made visible in response to electrical and electronic control of the individual segments. Like other similar electronic devices, the particular energization of the segments allows a variety of alpha-numerics to be displayed and the configuration of the particular segments may also be used to form pictorial or graphic displays. The segments are energized by providing a backplane voltage (which is an alternating current type voltage) to the device or series of devices, and another (alternating current type) voltage to selected electrical connections coupled to the individual segments so that the differential voltage between the backplane and the segments will make them luminous. By selectively controlling the application of the AC voltage to the individual segments, the AC driving voltage needed to make the segments luminous will be selectively applied to those individual segments.

Figure 1:
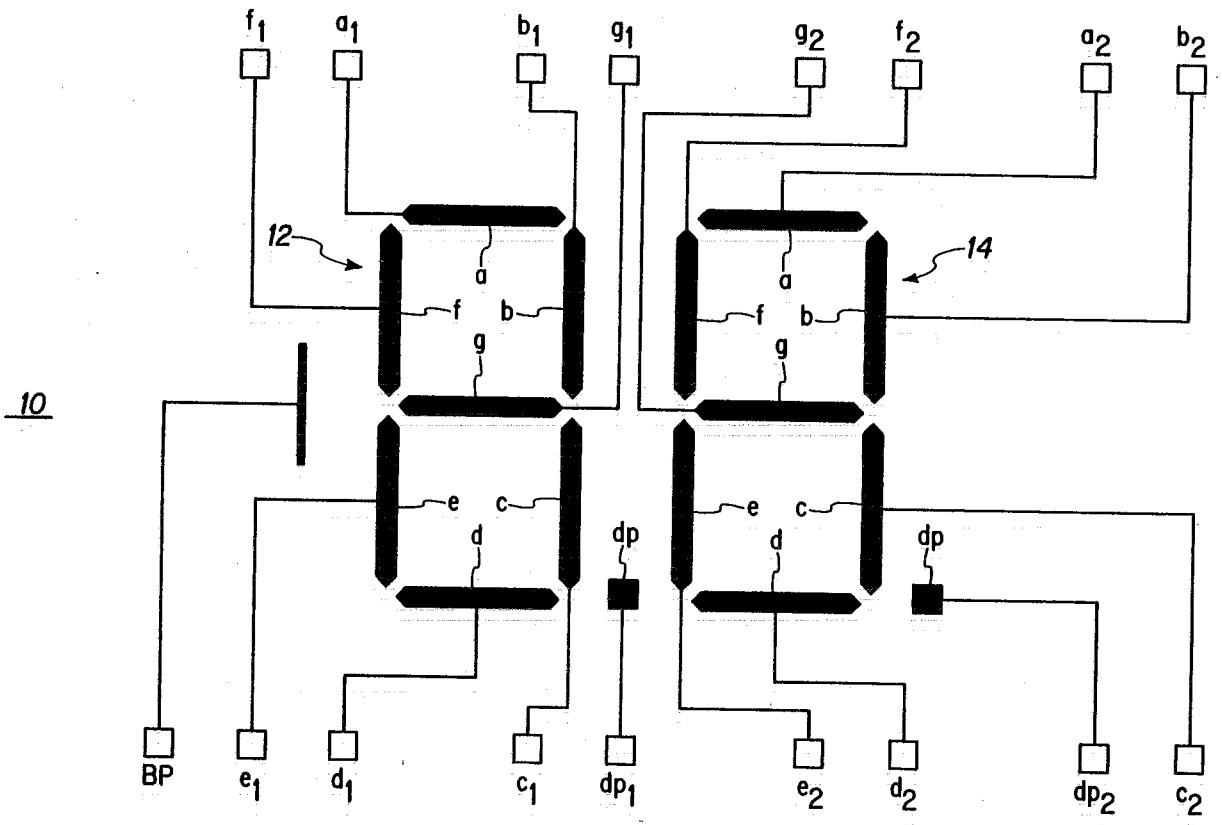
FIG. 1 is a schematic diagram representing a typical TFEL display including multiple segments and their associated electrical contacts.

An example of a typical TFEL display may be seen in FIG. 1 wherein the TFEL device 10 consists of a two-digit display with appropriate decimal points. This display consists of two TFEL characters 12 and 14 which include an electrical connection coupled to provide a terminal for receiving a backplane voltage BP. Each of the individual segments a–g form the individual TFEL characters 12 and 14, respectively. Electrical terminals a1-g1 are coupled to provide appropriate AC voltage to the segments of character 12, and selectively energize each segment in response to a predetermined code to create a particular alpha-numeric representation. Likewise, electrical terminals a2–g2 of the character 14 are coupled to the respective segments to also provide the appropriate AC voltage selectively to the segments to create an alpha-numeric character representation in response to a predetermined code. The display also includes elements dp which represent decimal points which are coupled electrically to terminals dp1 and dp2 to provide the appropriate AC voltages necessary to energize the elements to display decimal points at the appropriate times. Accordingly, by using conventional digital coding techniques to selectively energize individual ones of the segments and the decimal points, the segments can be made luminous and provide a visual indication of alpha-numeric characters of any predetermined form.

As has been noted previously, although the luminous efficiency of TFEL devices is fairly high (in the range of at least several lumens per watt), systems which have been used to produce actual displays have practical efficiencies which are much lower. The relative inefficiencies have been produced as a result of the highly capacitive electrical nature of the TFEL devices. This construction results in large reactive currents which cause any power supply drive circuit to dissipate energy much greater than the actual power required for the generation of light in the display itself.

Figure 2:
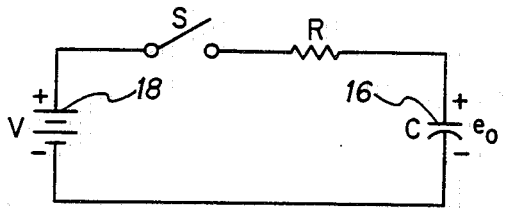
FIG. 2. is a schematic representation of a capacitive loading circuit exemplary of prior art attempts to create square wave TFEL drives.
Figure 3:
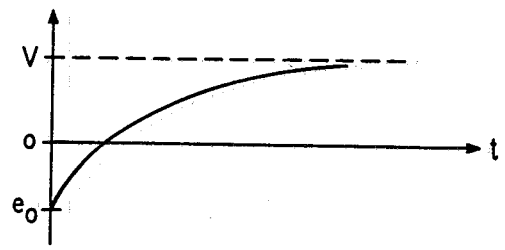
FIG. 3 is a graph showing the response to the operation of the circuit of FIG. 2.

By way of example, various prior art has attempted to drive the TFEL devices with square waves by switching voltage sources with alternating polarity. While this is the simplest TFEL drive technique that may be implemented with a variety of circuits, the circuit switch impedances prevent the formation of accurate square waves and more importantly dissipate large quantities of power in the process. Referring first to FIG. 2, an elementary circuit diagram representing square wave generation in a TFEL device is shown. In this instance, the TFEL device is simulated by a capacitor 16 which has a capacitance C precharged to a voltage $e_o$. A voltage source 18 having a voltage V is coupled through a switch S, which when closed, provides the voltage V through resistance R to the capacitor 16. If the voltage source V is applied across the TFEL device represented by capacitor 16 at a time t=0 by closing the switch S, the voltage across 16 is shown in FIG. 3 and a charging current i limited by resistance R defines the total effect of circuit and switch impedances. The resultant current as derived by conventional circuit analysis is:

$$i = \frac{V - e_o}{R} e^{-\frac{t}{RC}} \tag{1}$$

In this instance, the instantaneous power dissipation P in the system is described by:

$$P = i^2 R \tag{2}$$

and the total energy dissipated H is ultimately represented as:

$$\begin{aligned} H &= \int_0^\infty P\,dt \\ &= \int_0^\infty i^2 R\,dt \\ &= \int_0^\infty \left(\frac{V - e_o}{R} \cdot e^{-\frac{t}{RC}}\right)^2 R\,dt \\ &= \frac{1}{2} C(V - e_o)^2 \end{aligned} \tag{3}$$

This approximates the energy lost each time the voltage polarity is reversed in a square wave TFEL drive system, assuming that the time constant RC is much smaller than the period 1/f of the square wave, where f is the frequency. More particularly, for each reversal, $$e_o = -V_s \quad (4)$$

$$V = V_s \quad (5)$$

where $V_s$ is the saturation voltage level to which the TFEL device is driven. As a result, the following is true:

$$H = (1/2)(C)(2\,V_s)^2 = 2\,C\,V_s^2 \quad (6)$$

Since it is apparent that the above loss occurs twice per cycle, the average power loss for a full cycle is:

$$P_{sq} = 2\,H\,f = 4\,f\,C\,V_s^2 \quad (7)$$

where $P_{sq}$ equals the power loss for the square wave. It should be recognized that this loss is independent of the design of the driver circuit as long as the square wave is the signal used as the drive voltage. The parameters $V_s$, C and f are TFEL device characteristics directly related to the production of a given level of illumination. Accordingly, it will be recognized that if power efficiency is to be achieved, a fundamentally different mode of excitation, other than square wave, is required.

Figure 4:
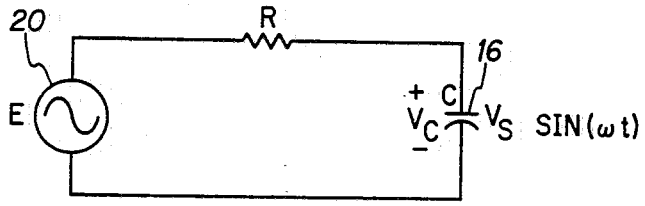
FIG. 4 is a schematic example of the use of a sinusoidal drive for a TFEL device.

One suggested technique for driving a TFEL device with other than a square wave is that depicted in FIG. 4. In this example, the circuit diagram shown is intended to be directly comparable with the square wave implementation shown in FIG. 2. In this instance, however, the voltage source 20 produces a sinusoidal voltage E to produce an output across the capacitor 16 which is equal to $V_s\sin(\omega t)$. Thus, the voltage E drives the capacitance 16 to a peak voltage $V_s$ through the circuit impedance R, all as specified with respect to FIG. 2. This circuit is distinguished, however, in that the voltage drive is achieved by use of the sinusoidal voltage source rather than a switching DC voltage source. Again, by analyzing the circuit with conventional techniques, it can be readily determined that the RMS capacitor current is represented as:

$$i = V_c/X_c = (V_s/\sqrt{2})/(\tfrac{1}{2}\pi f C) = \sqrt{2}\,\pi f C V_s \quad (8)$$

where $X_c$ is the impedance of the circuit. The power loss, therefore, in this mode of operation is represented as:

$$P_{sn} = i^2 R = 2R(\pi\,f\,C\,V_s)^2 \quad (9)$$

Using the above-calculated losses, the two different electrical drive modes may be compared by evalutating $P_{sn}$ with respect to $P_{sq}$ where:

$$\frac{P_{sn}}{P_{sq}} = [2R(\pi f C V_s)^2/4fCV_s^2] \quad (10)$$

-continued $$= (1/2)\,\pi^2 f R\,C$$

It can thus be seen that the sinusoidal electrical drive mode has a lower loss than the square wave drive mode whenever:

$$fRC < 2/\pi^2 \quad (11)$$

For a typical TFEL display with a total capacitance of 600 picofarads driven at 5000 Hz, any circuit resistance less than 68 k-ohms would satisfy this criterion. Practically, however, circuit resistance will most likely be less than 1 k-ohm so that:

$$\frac{P_{sn}}{P_{sq}} = (1/2)\,\pi^2\,(5000)(1000)(600)(10^{-12}) \simeq 0.0148 \quad (12)$$

This clearly indicates a significant improvement (on the order of a 68 times advantage) merely by controlling currents by limiting voltage rates of change rather than with circuit resistance.

While the above improvement in efficiency is clear, it will also be readily recognized that any loss reduction achieved by use of the sinusoidal drive will most likely be cancelled by the additional power supply losses required to produce the sine waves. As will be apparent, such additional power is necessary when the sinewaves are produced by the linear amplification of a low level sine waveform. However, in accordance with the present invention, the above-noted significant advantages can be achieved if the sine waves are produced by switching pulses of energy into an LC resonant circuit with a device such as that shown in FIG. 5.

Figure 5:
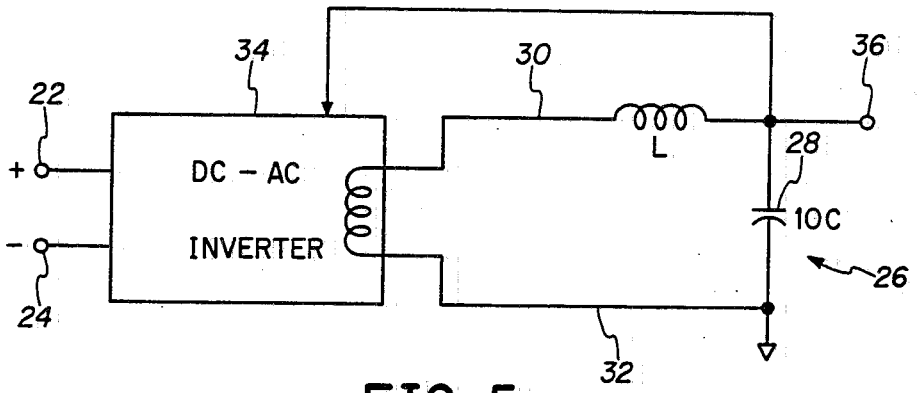
FIG. 5 is a block diagram representing a DC inverter resonant circuit for providing sinusoidal drive for a TFEL display.

Referring now to FIG. 5, there is shown a circuit which may be considered a synchronous switching power supply which provides pulses of energy phased to drive the resonant system 26 into oscillation. In particular, a source of DC power provides a voltage to the positive and common terminals 22 and 24, respectively, which voltage is synchronously switched to provide alternating output to an LC tank circuit 26 formed by inductance L and capacitor 28 coupled across output terminals 30 and 32. The switching circuit 34 is a typical DC-to-AC inverter which drives the tank circuit 26 to produce a sine wave output at 36. Since the DC-to-AC inverter 34 would normally be used to produce a conventional square wave drive signal in the prior art system, the losses for such a resonant drive supply circuit will be the same as those for the alternative square wave drive, except for small additional losses in the resonant drive supply due to circulating currents in the LC tank circuit 26. It should be recognized, that in this example the tank capacitance is 10C where C is the effective TFEL capacitance as noted with respect to FIGS. 2 and 4. The capacitance is fixed at this value (10C) to limit the change in tank frequency that will occur when a TFEL load is added. Accordingly, with a tank capacitance of 10C, the resonant frequency will change less than 5 percent from the condition when one segment a–g is energized to the condition when all segments a–g are energized.

In order to compare the square wave signal drive mode with the sinusoidal signal drive mode using the LC tank circuit, the power loss in the tank circuit must be considered. For this, the power loss $P_{tk}$ in the tank circuit can be described with respect to its quality factor Q wherein:

$$Q = \frac{2\pi \text{ (Energy stored in tank)}}{\text{(Energy dissipated in tank per cycle)}} \quad (13)$$

$$= 2\pi\left[\left(\frac{1}{2}\right)(10C)(V_s^2)\right]/P_{tk}\left(\frac{1}{f}\right)\Big]$$

Rearranging gives the result for $P_{tk}$ where:

$$P_{tk} = \frac{10\pi f C V_s^2}{Q} \quad (14)$$

$$= \frac{10\pi}{4Q} P_{sq}$$

$$= \frac{5\pi}{2Q} P_{sq}$$

The comparison of the square wave and sinusoidal signal drives can then be expressed by the ratio of their total losses, wherein the sinusoidal tank circuit drive is represented by the sum of the power losses $P_{sn}$ and $P_{tk}$ and the square wave power losses by $P_{sq}$, thus giving:

$$\frac{P_{sn} + P_{tk}}{P_{sq}} = \frac{P_{sn}}{P_{sq}} + \frac{P_{tk}}{P_{sq}} \quad (15)$$

$$= \frac{\pi^2}{2} f RC + \frac{5\pi}{2Q}$$

Now, by setting this ratio equal to one, it can be found that a Q of only 8 is needed to make the sinusoidal drive mode losses equal to those of the square wave drive mode losses. As will be apparent, since it would be difficult to implement an operable resonant drive supply with a Q this low, it is clear that a sinusoidal drive mode using the tank LC will inevitably provide a benefit of reduced power losses.

By way of example, a practical Q value of 100, with the f, R and C values used previously, results in a power loss ratio of:

$$\frac{P_{sn} + P_{tk}}{P_{sq}} = 0.093 \quad (16)$$

which is an improvement with the sinusoidal drive mode of more than 10 times the square wave drive mode.

In order to practically implement the use of such a power supply with TFEL devices, however, the sinusoidal voltage must be coupled to synchronize and drive the segments so that the average DC voltage across a TFEL device is zero at all times. This feature is necessary in order to avoid the degradation of TFEL material as may occur when the devices are subject to DC offset voltages. Accordingly, the resultant sinusoidal power supply is implemented in connection with the synchronizer and drive circuitry shown in FIG. 6.

Figure 6:
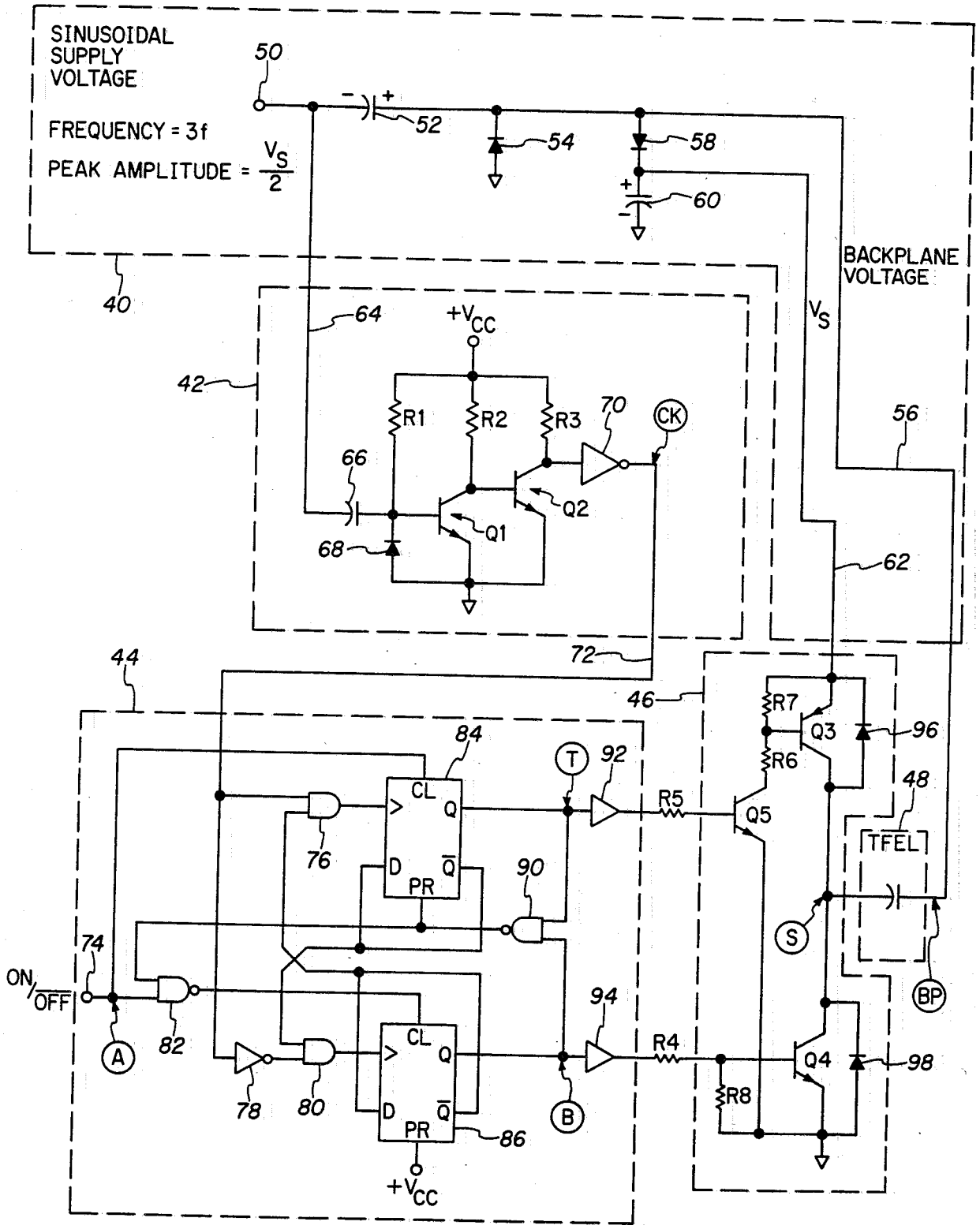
FIG. 6 is one embodiment of a TFEL drive system utilizing the sinusoidal supply produced by the circuit of FIG. 5.

Referring now to FIG. 6, the drive system consists generally of four components, including a power supply section 40, a synchronizer 42, driver logic 44, and a tri-state output 46. Each of the components will be described in more detail below in connection with their drive of a TFEL device 48 represented as a capacitor. As will be understood, the power supply 40 and synchronizer 42 (which may also be called a clock generator) are common portions of the system which may serve multiple TFEL segments. The drive logic and output circuit must be repeated for each TFEL segment in order for the individual devices to be driven. It should be understood also, that while various circuits are shown as discrete components, their identical functions could be fabricated on a single MOS chip or with any other conventional integrated circuit technique.

Figure 7:
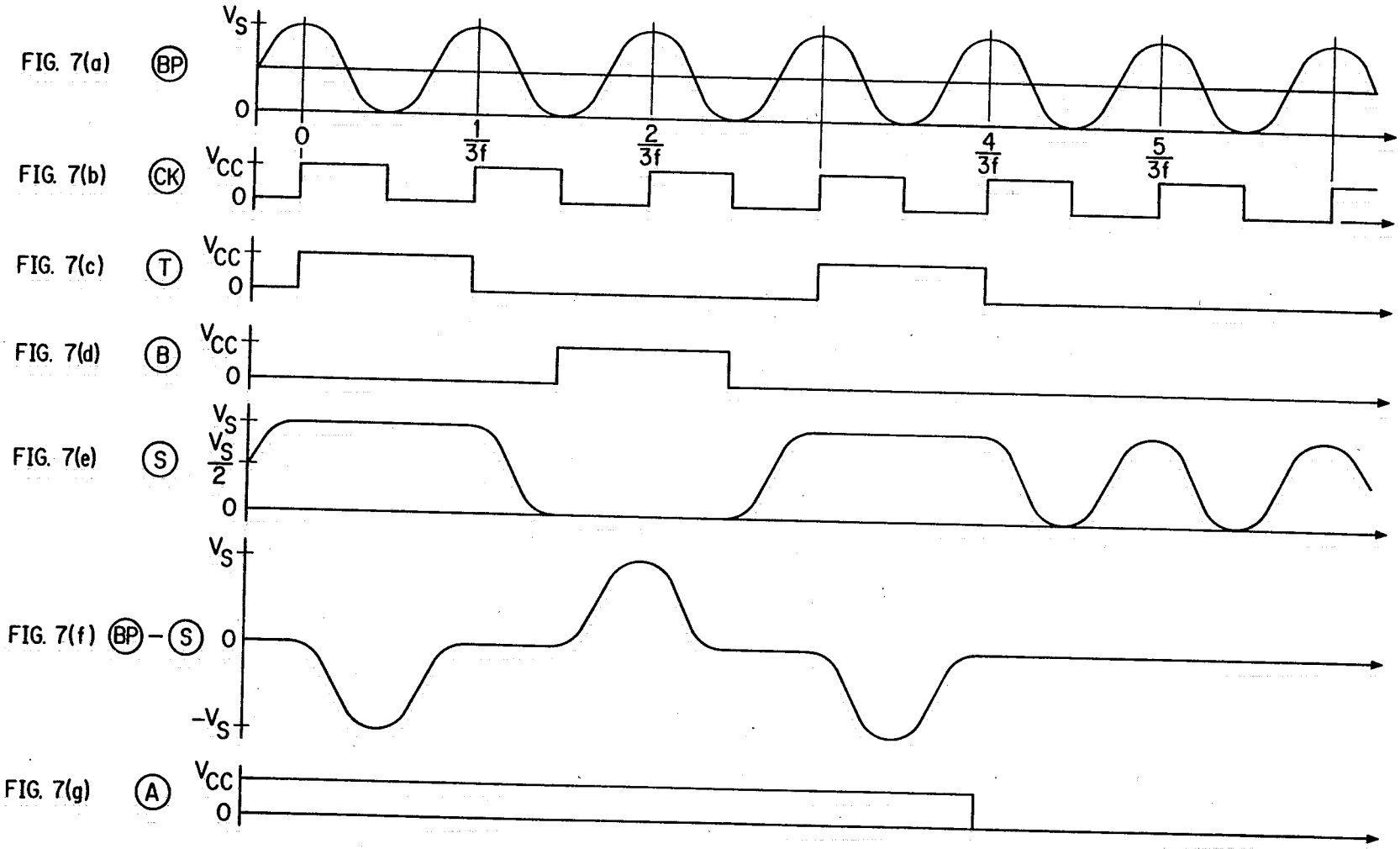
FIGS. 7(*a*)–(*g*) are diagrams of circuit waveforms produced by the sinusoidal supply and drive system of FIG. 6.

The general operation of the circuit can best be seen with reference to FIGS. 6 when considered in connection with the waveform diagrams of FIG. 7 corresponding to the waveforms generated at the identified nodes in FIG. 6. In the illustrated embodiment, input power from a sinusoidal voltage source of the type shown in FIG. 5 is coupled from output 36 to a terminal 50. The frequency of the sinusoidal voltage is 3f and its peak amplitude is $V_s/2$ where f and $V_s$ are the drive frequency and TFEL saturation voltage level as noted before. Terminal 50 is coupled to one terminal of the capacitor 52 having its second terminal coupled to the cathode of a diode 54 which in turn has its anode coupled to ground. This capacitor 52 and diode 54 add a DC component to the sinusoid and produce the backplane voltage BP on line 56 as shown by the waveform of FIG. *7a*. A second terminal of the capacitor 52 is also coupled to the anode of diode 58 which in turn has its cathode coupled to one terminal of a capacitor 60 having a second terminal coupled to ground. The capacitor 60 and diode 58 peak rectify the backplane voltage and produce the DC supply voltage $V_s$ as output on a line 62.

The synchronizing circuit 42 includes electrical line 64 which is coupled to receive a sinusoidal supply voltage at terminal 50 and provide that to one terminal of a capacitor 66 having a second terminal coupled to the base of a transistor Q1. A DC voltage source Vcc is coupled to one terminal of resistors R1, R2, and R3, each having their second terminals coupled respectively to the base, collector of Q1, and collector of a second transistor Q2 to form a bias circuit. Likewise, the emitters of transistors Q1 and Q2 are coupled to ground along with the anode of diode 68 having its cathode coupled to the base of transistor Q1. The collector of transistor Q2 is coupled through inverter 70 to produce an output on line 72 indicated as a clock signal ck which is a square wave waveform phase related to the backplane voltage BP. As seen in FIG. *7b*, this clock signal is high (logic "1") when the backplane sinusoid is decreasing and low (logic "0") when the backplane sinusoid is increasing. This phase relationship is achieved by the synchronizor detecting the polarity of the current through capacitor 66 which is a derivative of the backplane voltage BP (i=cdv/dt).

The drive logic 44 receives the clock signal from 72 and also a logic on/off signal at terminal 74 to control the individual energization of the TFEL segments. The circuit produces the waveforms shown in FIG. *7c* and *7d* as the outputs T and B in the drawing. This is achieved by coupling the output from 72 in one case as input to one terminal of AND gate 76 and in a second case as input through inverter 78 to a first terminal of AND gate 80. The on/off signal at terminal 74 is coupled as one input to NAND gate 82 and as an input to the clear terminal CL of D type flip-flop 84. The output of NAND gate 82 is provided as the clear terminal input CL to D type flip-flop 86. The output from AND gate 76 is provided to the clock input of flip-flop 84 while the output from AND gate 80 is provided to the clock input of flip-flop 86. The Q output from 84 provides the waveform T and is coupled to one input of NAND gate 90 while the Q output from flip-flop 86 produces the waveform B and is coupled as a second input to NAND gate 90. The NAND gate 90 has its output coupled as a second input to NAND gate 82 as well as to the preset input of flip-flop 84. The preset input of flip-flop 86 is coupled to DC voltage source Vcc. The $\overline{Q}$ output of flip-flop 84 is coupled as input to the data terminal of 84 as well to input to AND gate 80, while the $\overline{Q}$ output of flip-flop 86 is coupled as the second input to the data terminal of 86 and the second input to AND gate 76. The waveform outputs T and B are then respectively coupled through buffer amplifiers 92 and 94, respectively.

As will be appreciated, the output waveforms T and B will be determined in accordance with the logic command provided at point A in FIG. 6. Accordingly, when a command of logic "1" is provided at terminal 74, the two output waveforms T and B alternate with first the T waveform being at logic 1 and then both the T and B waveforms being at logic 0, and then the B waveform being at logic 1, followed by both waveforms being at logic 0, and so forth. For a command of logic 0 at the input terminal 74, both output waveforms T and B are continuously 0. The drive logic outputs from amplifiers 92 and 94 are coupled to the output circuit such that the two drive transistors Q3 and Q4 are independently controlled by the two drive logic output signals T and B, respectively. Transistor Q3 is driven through transistor Q5 wherein the outputs from 92 and 94 are respectively provided to the bases of transistors Q5 and Q4, through resistors R5 and R4. As will be seen, both output transistors Q3 and Q4 are turned off when both logic outputs are 0, and either output can conduct when its drive signal is a logic 1. Thus, the output circuit 46 is capable of providing a third high impedance state in which neither transistor is conducting.

The collector of transistor Q5 is coupled through resistor R6 to the base of transistor Q3 while the emitter of Q5 is coupled to ground. The base of transistor Q3 is coupled through resistor R7 to line 62 and the emitter of Q3. Diode 96 has its cathode coupled to the emitter of Q3 and its anode coupled to the collector of Q3. The collector of Q3 is also coupled to provide the second signal denoted by waveform S as the input to a second terminal of TFEL 48. The collector of Q3 is also coupled to the collector of Q4 and to the cathode of diode 98 having its anode coupled to ground. One terminal of resistor R8 is coupled to the base of Q4 and the other terminal coupled to ground to complete the circuit. The output waveform of node S and the waveform across the TFEL BP-S are as shown in FIGS. *7e* and *7f*.

The operation of the system can now be understood with reference to FIG. 6 and FIG. 7. It will be recognized that one side of the TFEL device 48 (represented as a capacitor in FIG. 6), is a display segment (one of a–g), and is clamped to the DC voltage $V_s$ from line 62 while the other side of the TFEL called the backplane is driven by the backplane voltage BP which moves from $V_s$ to zero and back to $V_s$ in a sinusoidal fashion. The clamp is then removed while waveform S follows BP to zero during a high impedance interval. The S waveform is then clamped to zero while waveform BP rises from zero to level $V_s$ and back to zero in a sinusoidal fashion. During the next high impedance interval, as the clamp is removed, waveform S follows waveform BP to the level $V_s$ and the cycle is completed. The voltage at S with respect to the circuit ground is shown as waveform S in FIG. *7e* and the voltage across the TFEL device BP-S is shown in FIG. *7f*. The above operation occurs when the command input to point 74 is a logic 1. It will be apparent that when the command input to 74 is a logic 0, the high impedance allows the waveform S to continuously follow waveform BP so that the TFEL voltage BP-S is zero.

As evident from the above-described operation, the TFEL voltage (BP-S) alternates between the positive saturation voltage $V_s$ and the negative saturation voltage $-V_s$, thereby producing an average DC component of 0 voltage. Thus, whether on or off, the average device voltage is 0 as required to eliminate any DC offset component contributing to device degradation. It should also be noted that the driver transistor switches never close when there is a net circuit voltage, thereby prohibiting any instantaneous change in the TFEL capacitor voltage. Accordingly, high charging currents are not required for the TFEL device.

As will be understood with respect to the above description, the backplane output at 56 may be common to many TFEL devices or segments and it is this common BP voltage that provides the drive power. Accordingly, the segments to be individually illuminated are selected by the command signals provided at input terminals 74, which cause synchronous clamping, thereby resulting in the desired waveform appearing across the selected segment a–g. In this manner, the sinusoidal supply voltage can be used in combination with the plurality of synchronizer and logic driver circuits to individually drive a plurality of segments.

Figure 8:
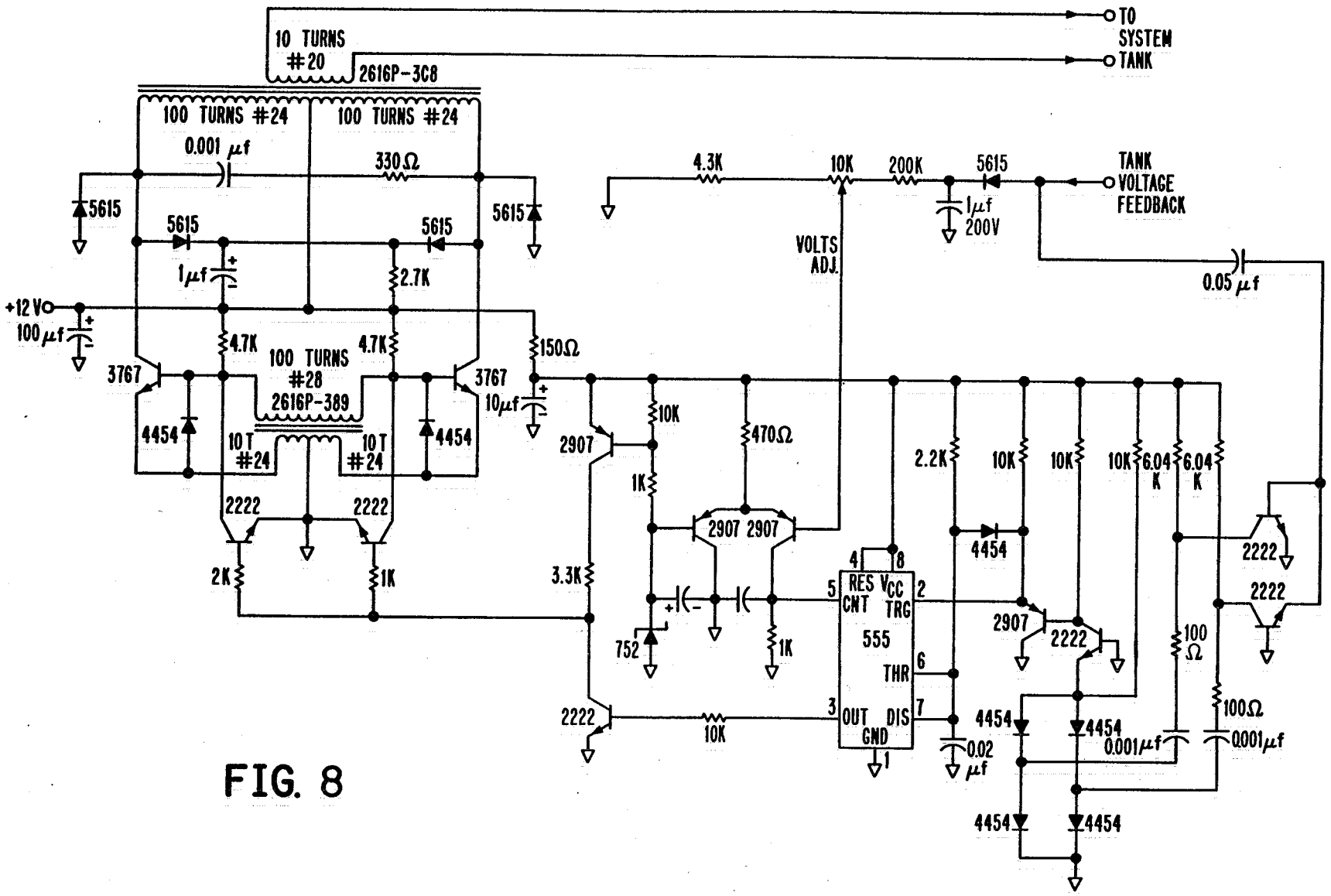
FIG. 8 is a schematic diagram showing one example of a resonant TFEL power supply that may be used to implement the circuit of FIG. 5.

Referring now to FIG. 8, an exemplary circuit for forming a tank LC sinusoidal power supply is shown. The circuit is constructed using components and component values identified in the drawing and is more particularly described in a co-pending application Ser. No. 523,999 entitled "Resonance Driver" by Wesley G. Runyan, owned by the same assignee and filed on even date herewith, which is hereby incorporated by reference in its entirety. It should be understood that the particular power supply circuit shown in FIG. 8 is only illustrative of one operable circuit that may be used in connection with the TFEL power supply and drive circuit of the present invention. Accordingly, since the operation of the circuit is apparent from the description in the referenced co-pending application, a detailed description of its operation herein is considered unnecessary.

As can be seen from the above description, the present power supply and drive system and technique enables TFEL displays to be driven with simplified circuitry and at significant increases in efficiency produced by a reduction in power dissipation. The circuit utilizes a sinusoidal power supply generated by use of an LC tank circuit, thereby allowing sinusoidal generation without significant power losses. The sinusoidal output is coupled to produce a backplane drive voltage in combination with synchronizing and drive logic selecting circuitry to produce individual energization of the TFEL segments so that they are made luminous without a DC offset voltage. Such synchronization and drive prevents any DC offset voltage from appearing during operation or inactivity so that the life of the TFEL devices is extended. The improved operation, reliability, low cost and simplicity enable such TFEL displays to be incorporated in a variety of sophisticated electronic equipment, particularly in connection with avionics displays for commercial and military aircraft. All of these are features which are not taught or shown by the prior art.

While particular circuits have been shown in describing the above-noted embodiment of the invention, it is apparent that other circuits could be used to produce similar results. Accordingly, it is apparent that other obvious variations and modifications of the present invention are possible in light of the above teachings. It is therefore to be understood that within the scope of the appended claims, the invention may be practiced otherwise than as specifically described.

What is claimed is:

1. A method for driving thin-film electroluminescent displays comprising:

generating an alternating signal and providing an output thereof;

coupling said alternating signal output to an inductance-capacitance resonant tank circuit to produce and maintain a resonant sinusoidal output;

coupling said resonant sinusoidal output to the backplane electrode of a thin-film electroluminescent display having a backplane electrode and a plurality of segment electrodes by coupling said electroluminescent display in electrical parallel with the capacitance of said resonant tank circuit; and controlling each of said plurality of segments to selectively produce a luminous display.

2. A power supply and drive system for a display comprising:

a display element having a common backplane electrode and a plurality of individual segment electrodes;

means for producing and maintaining a resonating sinusoidal output signal from an inductance-capacitance resonant tank circuit and coupling said output signal to said backplane electrode by coupling said display element in electrical parallel with the capacitance of said tank circuit; and means for applying control signals to selected ones of said plurality of segment electrodes for causing said selected segment electrodes to become luminous.

3. The system of claim 2 wherein said means for providing a sinusoidal resonant signal comprises a DC-AC inverter coupled to an inductance-capacitance tank circuit to cause said sinusoidal resonant output.

4. The system of claim 2 wherein said means for controlling comprises means for causing an alternating signal across the selected segment electrode to produce illumination so that there is no DC offset signal applied to the display element.

5. The system of claim 2 wherein said display element is a thin-film electroluminescent display.

6. The system of claim 2 wherein said means for applying control signals includes a digital logic control circuit coupled to receive digital inputs and produce a control signal to a segment electrode in response to said digital inputs.

7. A thin-film electroluminescent display system comprising:

a thin-film electroluminescent display having a backplane electrode and a plurality of segment electrodes which may be selectively controlled to form a luminous display;

a DC-AC inverter for providing an alternating signal output;

an inductance-capacitance tank circuit coupled to receive the alternating signal output of said DC-AC inverter and produce a resonant sinusoidal output;

means responsive to said resonant sinusoidal output for controlling said DC-AC inverter to maintain resonance of said resonant sinusoidal output, said resonant sinusoidal output being coupled to said backplane electrode by coupling said electroluminescent display in electrical parallel with the capacitance of said tank circuit; and means for selectively controlling the plurality of segment electrodes for producing a luminous display.

8. The system of claim 7 wherein said inductance-capacitance tank circuit comprises an inductor and a capacitor coupled to provide said resonant sinusoidal signal at a common terminal therebetween, said backplane electrode being coupled to said common terminal.

9. The system of claim 8 wherein said capacitance is at least ten times the inherent capacitance of the thin-film electroluminescent display.

10. The system of claim 8 further comprising means coupled to said common terminal for controlling said DC-AC inverter to maintain resonance of said sinusoidal signal.

11. The system of claim 7 wherein said means for selectively controlling comprises a digital logic circuit responsive to digital inputs for selecting the segment electrode to be illuminated.

12. The system of claim 7 wherein said means for selectively controlling is coupled to drive said segment electrodes so that there is a zero net DC offset signal between the segment electrodes and backplane electrode at all times.

13. A power supply and drive system for a display comprising:

a display element having a common backplane electrode and a plurality of individual segment electrodes;

means for producing and maintaining a resonating sinusoidal output signal from an inductance-capacitance resonant tank circuit and coupling said output signal to said backplane electrode; and means for applying control signals to selected ones of said plurality of segment electrodes to cause said selected segment electrodes to become luminous, said means for applying control signals comprising means for causing an alternating signal across the selected segment eletrode to produce illumination so that there is no DC offset signal applied to the display element.

14. A thin-film electroluminescent display system comprising:

a thin-film electroluminescent display having a backplane electrode and a plurality of segment electrodes which may be selectively controlled to form a luminous display;

a DC-AC inverter for providing an alternating signal output;

an inductance-capacitance tank circuit coupled to receive the alternating signal output of said DC-AC inverter and produce a resonant sinusoidal output;

means responsive to said resonant sinusoidal output for controlling said DC-AC inverter to maintain resonance of said resonant sinusoidal output, said resonant sinusoidal output being coupled to said backplane electrode; and means for selectively controlling the plurality of segment electrodes to produce a luminous display by driving said segment electrodes so that there is a zero net DC offset signal between the segment electrodes and backplane electrode at all times.

* * * * *